US005326256A

United States Patent [19]

Shike et al.

[11] Patent Number: 5,326,256

[45] Date of Patent: Jul. 5, 1994

[54] IGNITING DEVICE

[75] Inventors: Tsutomu Shike; Toshihiko Eguchi; Masaki Saito, all of Shizuoka, Japan

[73] Assignee: Tokai Corporation, Kanagawa, Japan

[21] Appl. No.: 910,164

[22] PCT Filed: Nov. 29, 1991

[86] PCT No.: PCT/JP91/01666

§ 371 Date: Sep. 3, 1992

§ 102(e) Date: Sep. 3, 1992

[87] PCT Pub. No.: WO92/09852

PCT Pub. Date: Jun. 11, 1992

[30] Foreign Application Priority Data

Nov. 25, 1991 [JP] Japan ..... 3-96547
Nov. 25, 1991 [JP] Japan ..... 3-96548

[51] Int. Cl.[5] ..... F23Q 7/12

[52] U.S. Cl. ..... 431/255; 431/258; 431/266

[58] Field of Search ..... 431/255, 266, 258, 344

[56] References Cited

U.S. PATENT DOCUMENTS 4,610,624 9/1986 Bruhn ..... 431/255
4,778,380 10/1988 Nitta ..... 431/255
5,154,601 10/1992 Capilla ..... 431/255

FOREIGN PATENT DOCUMENTS 1905000 10/1970 Fed. Rep. of Germany ..... 431/255
61-84371 6/1986 Japan .
62-45560 3/1987 Japan .
63-30049 8/1988 Japan .

*Primary Examiner*—Jones: Larry
*Attorney, Agent, or Firm*—Brumbaugh, Graves, Donohue & Raymond

[57] ABSTRACT

A gas reservoir, a valve mechanism for controlling gas supply from the reservoir and a piezoelectric unit are incorporated into a body portion assembly. A rod portion is formed by connecting a hard gas pipe to a gas injection nozzle provided in a tip of a rod-like metal tubular member and electrically connecting the gas injection nozzle on one end of the gas pipe and a terminal member on the other end of the same by way of a wire which extends through the gas pipe. The body portion assembly and the rod portion are assembled into a unit by engaging the base portion of the rod portion with an engagement portion of the body portion assembly, thereby connecting the gas pipe in the rod portion to the valve mechanism in the body portion assembly and electrically connecting the metal tubular member in the rod portion to the piezoelectric unit in the body portion assembly.

1 Claim, 3 Drawing Sheets

IGNITING DEVICE

FIELD OF THE INVENTION

This invention relates to an igniting device which injects flame from a nozzle by igniting fuel gas discharged from a built-in gas reservoir.

BACKGROUND OF THE INVENTION

In an igniting device such as an igniting rod or a table gas lighter, flame is injected from a tip of a rod-like portion which projects from a valve mechanism which controls gas supply from a gas reservoir. A gas pipe for supplying fuel gas to a fuel nozzle on the tip of the rod-like portion and a wire for supplying a discharge voltage for producing spark extend from the body portion and respectively connected to the fuel nozzle and a discharge electrode on the tip of the rod-like portion.

The gas pipe is directly connected at an end to the valve mechanism in the body portion and is connected at the other end to the gas injection nozzle. The wire also extends from the piezoelectric unit to which it is connected at an end and connected to the discharge electrode.

In this type of the igniting device, it has been difficult to automate the process of assembling the device.

That is, said gas pipe and said wire are formed of soft material and accordingly are not easily handled to be connected at the ends thereof to other parts and to be mounted in the space extending from the body portion to the end of the extended pipe member. Even though the valve mechanism is made into a unit form to facilitate the automatic assembling process, the above-mentioned structure of the igniting device including the gas pipe and the wire has been a bar to the automation of the final assembling process.

In view of the foregoing observations and description, the primary object of the present invention is to provide an igniting device in which the automation of the assembling process is facilitated and the manufacturing cost is lowered.

DISCLOSURE OF THE INVENTION

In accordance with the present invention, there is provided an igniting device wherein a gas reservoir, a valve mechanism and a piezoelectric unit are incorporated into a body portion assembly, a rod portion is formed by connecting a hard gas pipe to a gas injection nozzle provided in a tip of a rod-like metal tubular member and electrically connecting the gas injection nozzle on one end of the gas pipe and a terminal member on the other end of the same by way of a wire which extends through the gas pipe, and the body portion assembly and the rod portion are assembled into a unit by engaging the base portion of the rod portion with an engagement portion of the body portion assembly, thereby connecting the gas pipe in the rod portion to the valve mechanism in the body portion assembly and electrically connecting the metal tubular member in the rod portion to the piezoelectric unit in the body portion assembly.

In such an igniting device, final assembly can be conducted by simply engaging the base portion of the rod portion with an engagement portion of the body portion assembly since the body portion assembly and the rod portion assembly are formed separately from each other and the wire is disposed in the hard gas pipe. In response to the final assembly, the gas pipe in the rod portion is connected to the valve mechanism in the body portion assembly so that fuel gas from the valve mechanism can be led to the gas injection nozzle on the tip of the rod portion through the gas pipe and the metal tubular member in the rod portion is electrically connected to the piezoelectric unit in the body portion assembly so that spark for igniting fuel gas discharged from the nozzle can be produced by discharge voltage imparted to the nozzle through the metal tubular member and the wire, whereby assembly of the igniting device is facilitated to make feasible automation of assembly and the manufacturing cost is lowered.

PREFERRED EMBODIMENT OF THE INVENTION

An embodiment of the present invention will be described with reference to the drawings, hereinbelow.

Figure 1:
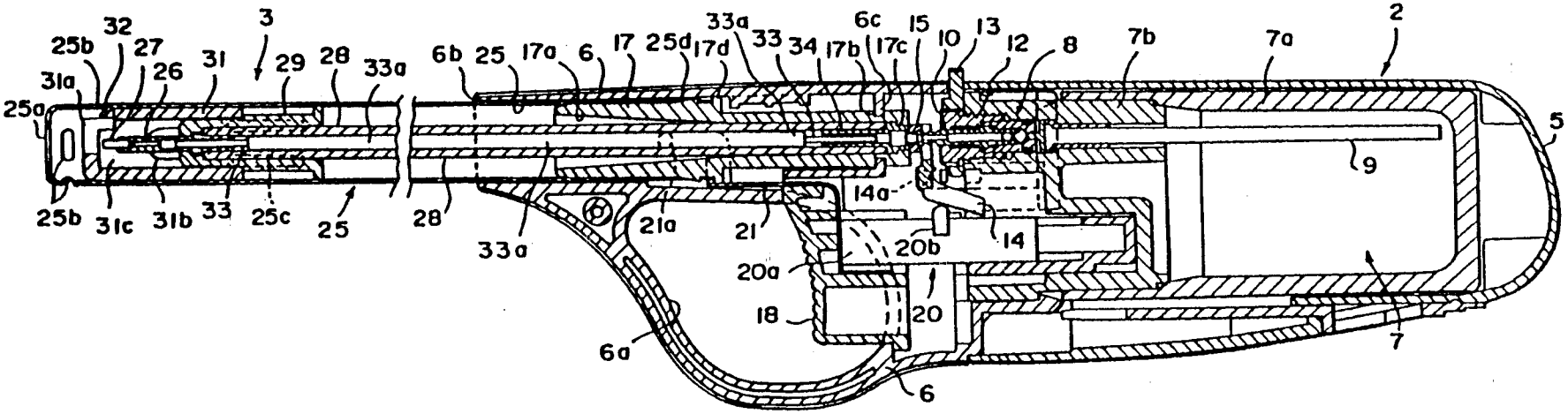
FIG. 1 is a cross-sectional view of an igniting device in accordance with an embodiment of the present invention in the assembled state.
Figure 2:
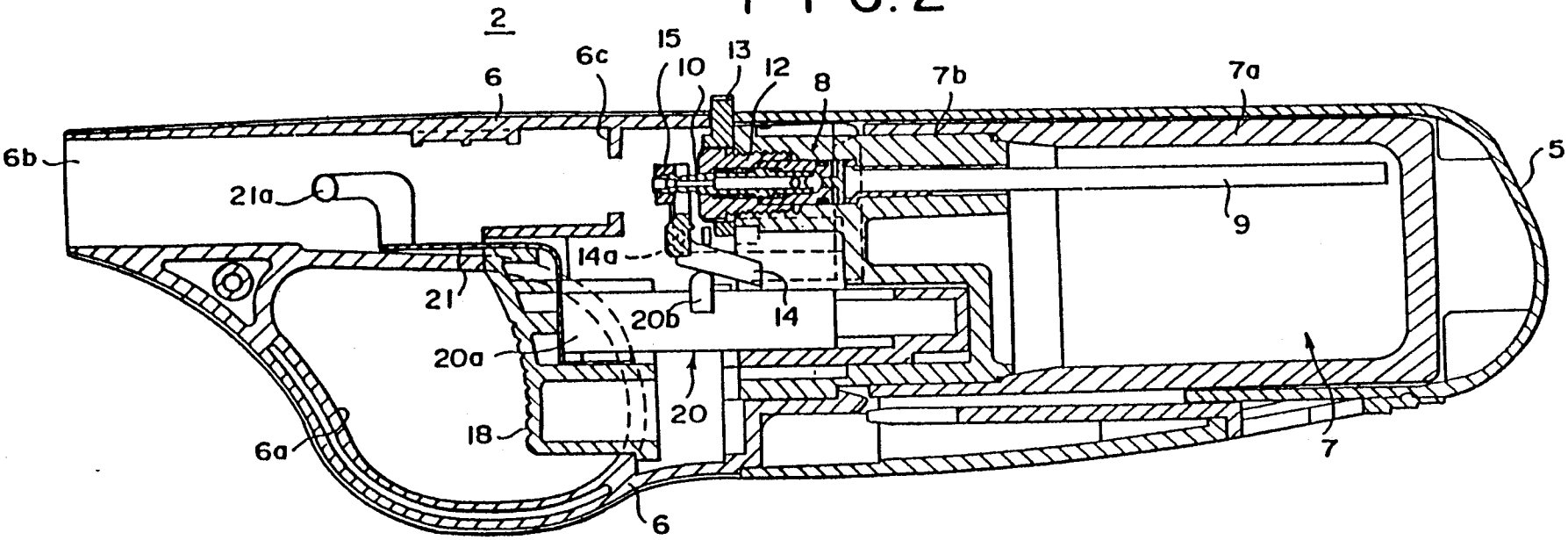
FIG. 2 is a cross-sectional view of the body portion assembly.
Figure 3:
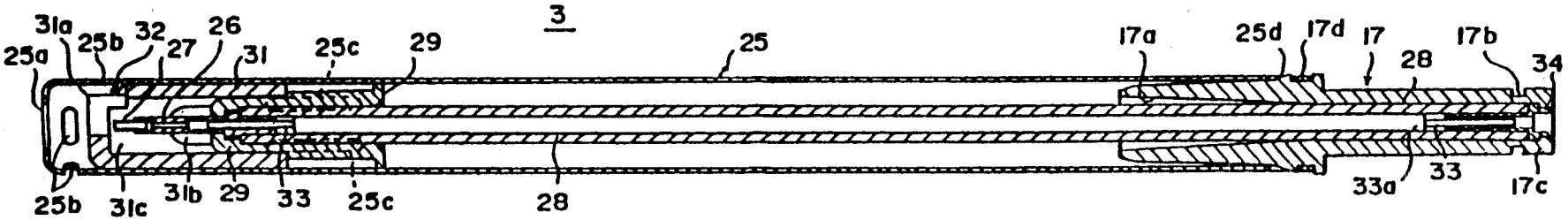
FIG. 3 is a cross-sectional view showing the rod portion.

FIG. 1 is a cross-sectional view of an igniting device in accordance with an embodiment of the present invention in the assembled state, FIG. 2 is a cross-sectional view of the body portion assembly, and FIG. 3 is a cross-sectional view showing the rod portion.

The igniting device 1 comprises a body portion 2 and a rod portion 3 extending from the body portion 2. The body portion 2 and the rod portion 3 are in the form of separate units as shown in FIGS. 2 and 3 and are engaged with each other to be integrated into the igniting device 1.

The body portion 2 has a casing comprising a reservoir cover 5 and an intermediate casing 6 disposed in front of the reservoir cover 5. The reservoir cover 5 is in the form a tubular member open at the front end, and the intermediate casing 6 comprising left and right halves. The intermediate casing 6 has an opening **6*a* for accommodating an ignition lever 18 in the lower portion thereof and an opening 6*b* in the front end thereof through which the rod portion 3 is received in the body portion 2** and connected thereto.

A gas reservoir 7 in which pressurized fuel gas is stored is accommodated in the reservoir cover 5. The gas reservoir 7 comprises a reservoir body **7*a* and an upper lid 7*b* connected to the reservoir body 7*a*. A valve mechanism 8 for controlling gas supply from the gas reservoir 7 is provided in the upper lid 7*b*. That is, a wick 9 is inserted into the gas reservoir 7 and the fuel gas is supplied through the wick 9 and a nozzle member 10 is disposed in the gas supply passage. The nozzle member 10 is urged rearward by a spring (not shown), and when the nozzle member 10 is moved forward, the gas supply passage is opened and the fuel gas is supplied, and when the nozzle member 10 is returned rearward under the force of the spring, the gas supply passage is closed and gas supply is interrupted. The amount of gas supply or the size of the flame is adjusted by rotating a flame adjustment knob 13 which is connected to an adjustment sleeve 12** and projects outward.

One end of a lever 14 for opening the nozzle member 10, i.e., for moving forward the nozzle member 10, is engaged with a front end portion of the nozzle member 10. A sealed packing 15 is mounted on the tip of the nozzle member 10 forward of the lever 14. The other end portion of the lever 14 is connected to a piezoelectric unit 20 which will be described later.

Said ignition lever 18 is mounted inside the opening 6*a* of the intermediate casing 6 to be slidable back and forth. The piezoelectric unit 20 is provided between the the ignition lever 18 and the upper lid 7*b* of the gas reservoir 7. The piezoelectric unit 20 is for supplying discharge voltage, and when the ignition lever 18 is pulled rearward, a sliding portion 20*a* is moved rearward to cause a projection 20*b* to engage with the lever 14 and rotate it and discharge voltage generated in the piezoelectric unit 20 is supplied.

That is, the lever 14 is L-shaped and is supported to rotate about a pivot 14*a*. When said the other end of the lever 14 is rotated upward in response to the rearward movement of the projection 20*b* of the sliding portion 20*a*, said one end of the lever 14 pulls forward the nozzle member 10 to open the gas supply passage. The projection 20*b* doubles as one terminal for the discharge voltage and is electrically connected to the nozzle member 10 through the lever 14 which is made of conductive resin.

The sliding member 20*a* of the piezoelectric unit 20 doubles as the other terminal for the discharge voltage and is electrically connected to a contact 21*a* by way of an earth plate 21. The contact 21*a* is disposed beside an intermediate portion of a pipe holder 17 which will be described later. That is, the earth plate 21 is sandwiched between the piezoelectric unit 20 and the ignition lever 18 at its base portion, is bent forward above the ignition lever 18, and then is cranked at portion near an outer engagement portion 17*d* of the pipe holder 17. The front end of the earth plate 21 is formed into the contact 21*a* which is disposed on one side of the central axis of the pipe holder 17 and is pressed against the pipe holder 17 toward the central axis thereof. The earth plate 21 is moved in response to slide of the ignition lever 18.

The rod portion 3 comprises a metal tubular member 25 and a gas injection nozzle 26 which is mounted in the front end of the tubular member 25. The gas injection nozzle 26 has a nozzle tip 27 on its front end and is fitted on the front end of a gas pipe 28 at its rear end. The nozzle 26 is secured by a cap-like nozzle holder 29 fitted thereon. The holder portion 29 has a flared rear end portion which is positioned coaxially with the tubular member 25 in contact with the inner surface of the tubular member 25. The front end portion of the gas injection nozzle 26 projects forward from the nozzle holder 29 and the cover portion 31 surrounds the front end portion of the gas injection nozzle 26 at a predetermined distance therefrom. The nozzle cover 31 is in the form of a cap and has a front wall portion which is cut away to form a V-shaped opening 31*a* which is flared upward from a portion substantially aligned with the nozzle tip 27. A pair of air inlet grooves 31*b* are formed in the rear end portion of the nozzle cover 31.

The tubular member 25 has a front end wall and a flame port 25*a* through which flame is injected outward is formed in the central portion of the front end wall. Air intake ports 25*b* are formed in the upper side portions of the tubular member 25 behind the flame port 25*a*. Further, a part of the tubular member 25 is bent inward behind the air intake port 25*b* to form a discharge electrode 32. The portion of the tubular member 25 at which the discharge electrode 32 is formed forms another air intake port 25*b*. Further four elongated air intake ports 25*c* are formed in the tubular member 25 to extend in the longitudinal direction of the tubular member 25 at portions distant from the front end.

The nozzle cover 31 is accommodated in the tubular member 25 so that the discharge electrode 32 is positioned above the V-shaped opening 31*a* thereof. When the nozzle holder 29 with the gas injection nozzle 26 is mounted on the nozzle cover 31, the air intake ports 25*c* formed in the tubular member 25 communicate with the space around the nozzle holder 29 and air introduced into the inside of the tubular member 25 through the air intake ports 25*c* flows into the space 31*c* in the nozzle cover 31.

The gas pipe 28 the front end portion of which is inserted into the nozzle holder 29 is for leading the fuel gas to the gas injection nozzle 26 and is made of hard material. The gas pipe 28 extends through the tubular member 25 along the central axis thereof and the rear end portion of the gas pipe 28 projects rearward outside the tubular member 25. An engagement portion 25*d* having an opening which is adapted to engage with the outer engagement portion 17*d* of the pipe holder 17 (will be described later) is formed in the rear end portion of the tubular member 25.

A covered wire 33 having a cover 33*a* extends through the gas pipe 28. The cover 33*a* is removed at front and rear end portions of the covered wire 33 and the core of the covered wire 33 is exposed at the front and rear end portions. A tubular terminal member 34 is mounted on the rear end portion of the gas pipe 28. That is, the front end portion of the terminal member 34 is fitted in the rear end portion of gas pipe 28, and the rear end portion of the terminal member 34 is fitted in an inner engagement portion 17*c* of the pipe holder 17. An annular flange is formed on the peripheral surface of the rear end portion of the terminal member 34 and abuts against the rear end of the gas pipe 28. The rear end portion of the exposed core of the covered wire 33 is connected to the terminal member 34 and the front end portion of the same is connected to the gas injection nozzle 26, whereby the terminal member 34 and the gas injection nozzle 26 are electrically connected by the covered wire 33.

The pipe holder 17 is a tubular member having a longitudinal through hole 17*a* into which the rear end portion of the gas pipe 28 is inserted. The through hole 17*a* has a large diameter at the front end portion and is smoothly tapered rearward to form a guide surface. The pipe holder 17 is further provided with an annular groove 17*b* which is formed on the outer peripheral surface of the rear end portion thereof and is adapted to be engaged with an engagement portion 6*c* formed on the inner surface of the intermediate casing 6. The sealed packing 15 mounted on the tip of the nozzle member 10 of the valve mechanism 8 is adapted to abut against the rear end of the pipe holder 17. The rear end portion of the pipe holder 17 is provided with the inner engagement portion 17*c* which abuts against the end of the terminal member 34. The front end portion of the pipe holder 17 is fitted in the rear end portion of the tubular member 25 and the outer engagement portion 17*d* which is formed on the outer surface of the intermediate portion of the pipe holder 17 and comprises a flange portion and a projection for preventing draw is in engagement with an engagement portion 25*d* of the tubular member 25.

The rod portion 3 is connected to the body portion 2 in the following manner. That is, the pipe holder 17 in which the gas pipe and the tubular member 25 have been incorporated is set to one of the halves of the intermediate casing 6 of the body portion 2 so that the annular groove 17*b* of the pipe holder 17 is engaged with the engagement portion 6*c* of the intermediate casing 6, and then the other half of the intermediate casing 6 is incorporated with said one of the halves.

In the assembled state, the terminal member 34 and the nozzle member 10 are connected, and the gas passage in the gas pipe 28 and the gas passage in the valve mechanism 8 communicate with each other. Further, the contact 21*a* of the earth plate 21 is in contact with the outer surface of the tubular member 25 and the discharge electrode 32 is electrically connected with the piezoelectric unit 20. The gas injection nozzle 26 is electrically connected with the piezoelectric unit 20 by way of the nozzle member 10, the terminal member 34 and the covered wire 33.

The operation of the igniting device 1 of this embodiment will be described, hereinbelow. When the ignition lever 18 is pulled rearward, the nozzle member 10 of the valve mechanism 8 is moved forward and the fuel gas is discharged from the gas reservoir 7 as described above. The fuel gas discharged from the gas reservoir 7 is injected from the nozzle tip 27 of the gas injection nozzle 26 through the space in the gas pipe 28 which is narrowed by the covered wire 33 inserted therein. Since the gas passage in the gas pipe 28 is narrowed as described above, the velocity of the fuel gas flowing therethrough is high and the fuel gas can reach the nozzle tip 27 in a short time after opening of the valve mechanism 8.

Further, in response to operation of the ignition lever 18, the piezoelectric unit 20 produces an alternating discharge voltage which is applied between the discharge electrode 32 and the nozzle tip 27 in the rod portion 3, whereby the fuel gas injected from the nozzle tip 27 is ignited.

Since the fuel gas can be stably supplied to the gas injection nozzle 26 in time by virtue of the narrowed gas passage in the gas pipe 28 and since a part of fuel injected from the nozzle tip 27 dwells in the space 31*c* in the nozzle cover 31, the fuel gas injected from the nozzle tip 27 can be well ignited by spark produced by the discharge voltage.

The nozzle tip 27 is positioned in the nozzle cover 31 and is covered with the nozzle cover 31 and the tubular member 25. Accordingly, wind, oil, fire work or the like which blows off flame cannot directly act on the nozzle tip 27, and the nozzle tip 27 and the gas injection nozzle 26 are protected from foreign matter which can adhere to the nozzle tip 27 and the gas injection nozzle 26 and weaken discharge spark.

We claim:

1. An igniting device comprising a body portion assembly including a gas reservoir, a valve mechanism for controlling gas supply from the reservoir and a piezoelectric unit and an engagement portion including an intermediate casing with transversely-extending engagement parts separable along a longitudinal plane and providing for gas communication with the valve mechanism and for electrical communication with the piezoelectric unit, a rod portion including a rod-like metal tubular member having a base portion with an annular groove at one end and a gas injection nozzle at the other end and including a hard gas pipe extending between the base portion and the gas injection nozzle to convey gas thereto, and a wire extending from a terminal in the base portion to the nozzle to provide electrical connection therebetween, the gas injection nozzle, the body portion assembly and the rode portion being assembled into a unit by engagement of the annular groove in the base portion of the rod portion with the engagement parts in the engagement portion of the body portion assembly so as to connect the gas pipe int he rod portion to the valve mechanism in the body portion assembly and to electrically connect the metal tubular member in the rod portion to the piezoelectric unit in the body portion assembly.

* * * * *